United States Patent [19]

Fridjhon

[11] Patent Number: 4,998,631

[45] Date of Patent: Mar. 12, 1991

[54] WINE RACK

[76] Inventor: Michael Fridjhon, 27 Durris Rd., Forest Town, Johannesburg, Transvaal, R.S.A., South Africa

[21] Appl. No.: 413,339

[22] Filed: Sep. 27, 1989

[30] Foreign Application Priority Data

Jan. 26, 1989 [ZA] South Africa ..... 89/0620

[51] Int. Cl.[5] ..... A47B 73/00

[52] U.S. Cl. ..... 211/74; 211/181; 211/194

[58] Field of Search ..... 211/74, 194, 90, 106, 211/181

[56] References Cited

U.S. PATENT DOCUMENTS

| | | | |
|---|---|---|---|
| 1,975,046 | 9/1934 | Larkin | 211/74 X |
| 2,018,002 | 10/1935 | Avery | 211/74 |
| 2,066,823 | 1/1937 | Cohen | 211/106 X |
| 2,558,611 | 6/1951 | Emmart | 211/74 |
| 3,160,278 | 12/1964 | Varkala | 211/74 |
| 4,117,783 | 10/1978 | Eckel et al. | 211/194 X |
| 4,498,592 | 2/1985 | Colucci | 211/106 X |
| 4,765,495 | 8/1988 | Bisk | 211/181 X |

*Primary Examiner*—Blair M. Johnson
*Attorney, Agent, or Firm*—Michael N. Meller

[57] ABSTRACT

The invention provides a wine rack comprising a pair of planar support members each defining a plurality of cradle formations for receiving a wine bottle or the like, and one or more brace elements which are adapted collapsibly to secure the support members to one another in spaced relationship with cradle formations aligning with one another so that in use these are capable of supporting a wine bottle in a horizontal or tilted attitude.

8 Claims, 2 Drawing Sheets

WINE RACK

FIELD OF THE INVENTION

This invention relates to a wine rack.

BACKGROUND OF THE INVENTION

Conventional wine racks are bulky and present problems with transportation and storage. It is accordingly an object of the present invention to provide a novel wine rack which it is believed will overcome or at least minimize the above mentioned problems.

OBJECT OF THE INVENTION

According to the invention a wine rack comprises a pair of planar support members each defining a plurality of cradle formations for receiving a wine bottle or the like, and one or more brace elements which are adapted collapsibly to secure the support members to one another in spaced relationship with cradle formations aligning with one another so that in use these are capable of supporting a wine bottle in an horizontal or tilted attitude.

SUMMARY OF THE INVENTION

Further according to the invention the brace elements are pivotally mounted on the support members to enable the latter to pivot onto one another into a collapsed configuration. In order to assemble the wine rack of the invention, a simple reverse pivotal operation will again space these support members from one another.

Still further according to the invention the support members include generally vertically disposed uprights and the brace elements are pivotally secured to the uprights, preferably by means of tubular members through which the uprights pass and which are rotatable on the uprights, with the brace elements being secured to such tubular elements.

Also according to the invention anchoring means is provided for securing an assembled wine rack to a support such as a wall structure. Such anchoring means could for example comprise brackets which are secured to or constituted by an extension of the brace elements.

Yet further according to the invention coupling means is provided at the upper and/or lower extremities of a rack, preferably at the uprights thereof to enable a rack to be linked on an underlying rack. Such coupling means could for example be spigot and socket means and in a preferred arrangement the extremity of each upright will define a spigot and a tubular socket will be provided to engage aligned spigots of an underlying and superimposed wine rack.

In a preferred arrangement according to the invention the support members each comprise a plurality of horizontally disposed spaced rod elements formed to a sinuous profile to define alternate peaks and valleys, with the valleys constituting the cradles for the wine bottles. With such an arrangement it is envisaged that the rod members will be secured to the uprights.

Other features of the invention will appear from the embodiment which is described below purely by way of example with reference to the accompanying drawings wherein:

DETAILED DESCRIPTION OF THE INVENTION

Figure 2:
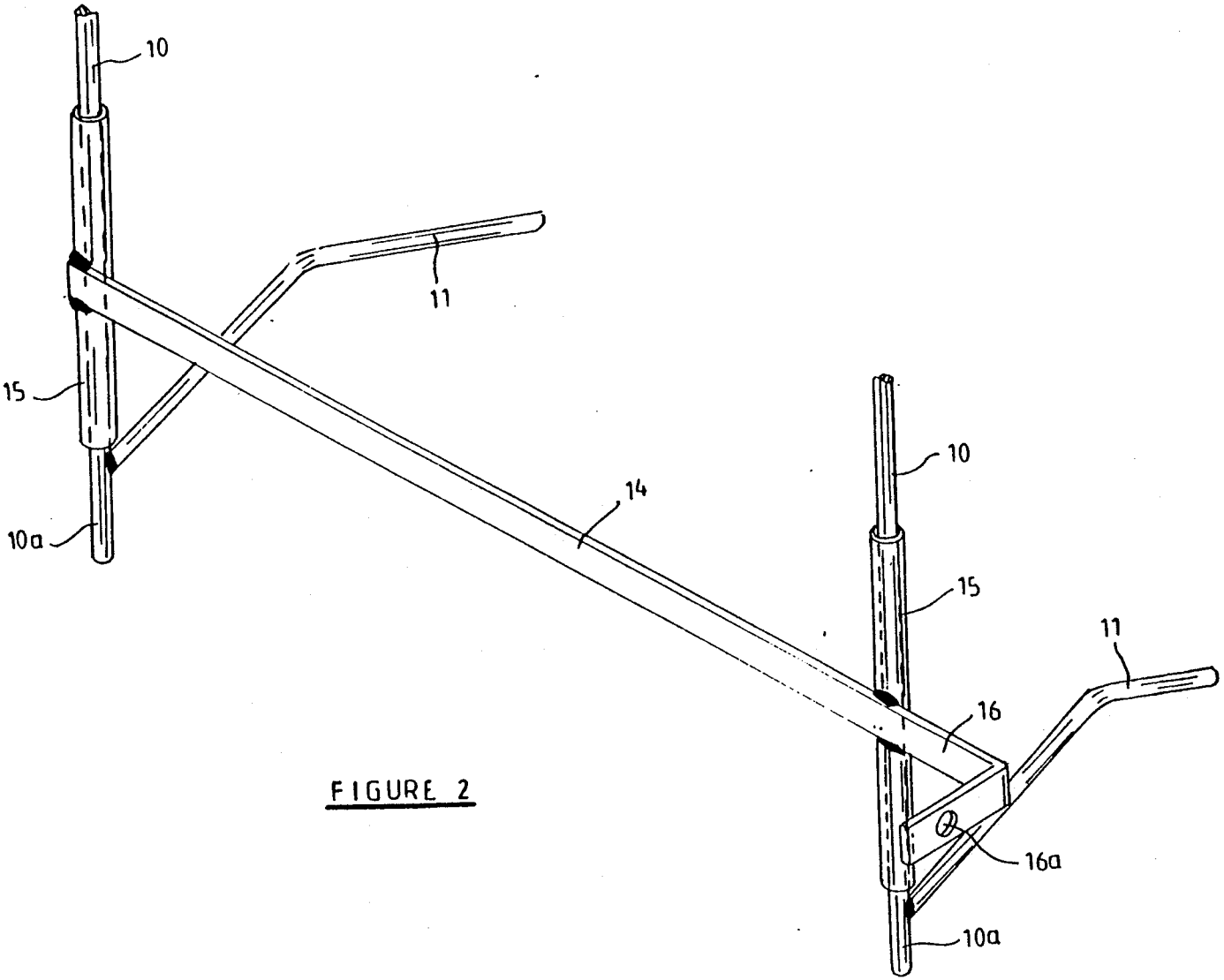
FIG. 2 is an enlarged perspective view of portion of the wine rack in FIG. 1.

Referring to the drawings a wine rack in accordance with the invention comprises a pair of spaced of planar support members shown at 1 and 2 respectively which each define a plurality of cradles for a wine bottle 12 or the like with the cradles defined by the support member 1 aligning with those in the support member 2 when the wine rack is erected. If desirable the cradles of the support 1 could receive the neck portion of a wine bottle 12 and could accordingly be raised relative to the corresponding cradles of the support member 1, received to cradle the body portion of the bottle 12 as shown in FIG. 2. Alternatively both supports could receive the body portion of the bottle 12 as shown.

In a preferred embodiment of the invention support members 1 and 2 will each be constituted by a pair of spaced vertical uprights 10 with a plurality of vertically spaced rod elements 11 of sinuous profile extending between the uprights 10. The rod elements 11 define alternate peaks and valleys, with each valley constituting a cradle for the wine bottle 12 or the like. The rod elements 11 could be secured to the uprights 10 by means of welding, swaging etc.

Figure 1:
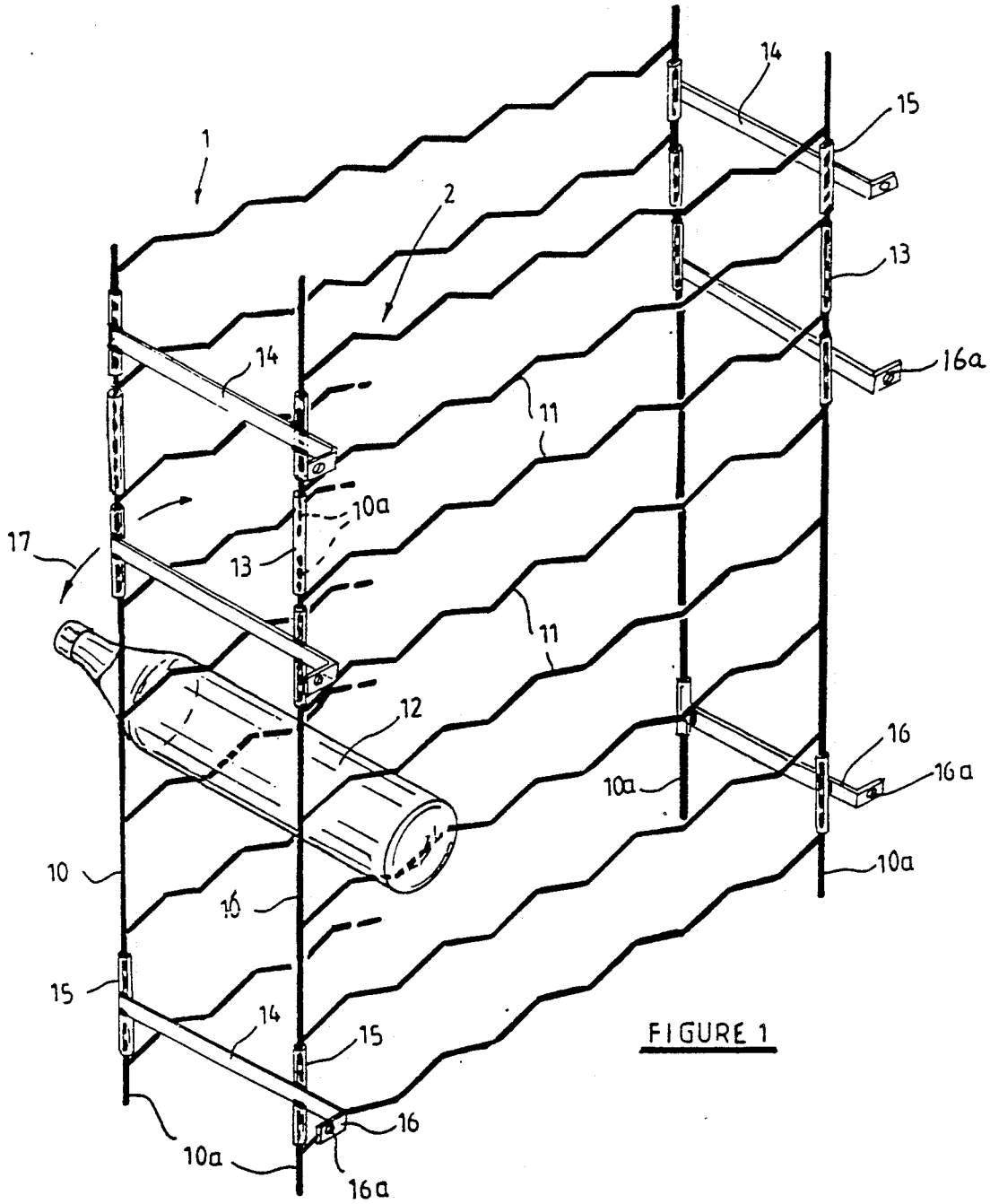
FIG. 1 is a perspective view of the wine rack in accordance with the invention.

The respective support members 1 and 2 are held in a spaced relationship as shown in FIG. 1 by means of brace elements 14 which extend between the members. Preferably an upper and a lower brace member is provided at each end of the wine rack, as shown. It is a feature of the invention that the wine rack is capable of being dismantled readily for storage or transportation purposes, and likewise capable of easy erection. The invention accordingly provides that the brace elements 14 are pivotally coupled to the uprights 10 which will enable the support members 1 and 2 to pivot onto one another into an offset relationship when transformed to a dismantled stage. The members 1 and 2 will thus lie against one another very much reducing storage and transportation space. For hinging purposes, it is envisaged that the brace elements 14 will be secured by means of welding or the like to tubular elements 15 which are in turn rotatable on the uprights 10. Doubtless variations are possible in this regard. Thus for example in an alternative arrangement, not shown, the base elements 14 could simply be secured to the uprights by nuts and bolts passing through apertures in these or by means of suitable U-bolts or the like. With such an arrangement therefore the brace members 14 will be disconnected from the uprights 10 when the rack is in the disassembled position.

In order to secure a wine rack in tis erected configuration, the invention further provides brackets 16 which may conveniently be extensions of the brace elements 14 and which project to the rear of the wine rack as shown. In use the bracket 16 will be employed to secure the wine rack to a support surface such as a wall surface foe example by driving fasteners through apertures **16*a* in the brackets 16**.

A further feature of the invention provides for a plurality of wine racks to be mounted one on top of the other to a desired height. For this purpose spigot formations **10*a* are provided at the upper and lower extremities of the uprights 10. When positioning one wine rack on an underlying wine rack, the spigots 10*a* of the superimposed rack will be aligned with those of an underlying rack and will engage in socket formations defined by a tubular element 13. It will be appreciated that the tubular elements 13 could be secured to one or other of the spigot formations 10***a*.

The advantages of the wine rack of the invention will be apparent to persons skilled in the art. It will be appreciated that the wine rack will be durable, readily erectable, and transportable in bulk. It is envisaged that variations in detail of the invention will fall within the scope of the appended claims.

I claim:

1. A wine rack comprising a pair of support members each defining a plurality of cradle formations for receiving an article such as a wine bottle, and one or more brace elements which extend between the support members to secure the support members to one another in spaced relationship with opposed cradle formations aligning with one another when the rack is in an assembled state so that in use these are capable of supporting a wine bottle in a generally horizontal attitude; the brace elements being pivotally mounted on the support members to enable said support members to pivot on to one another into a collapsed configuration; and anchoring means for securing the wine rack in its assembled state to a support, the anchoring means comprising brackets which are defined an extension of the brace elements so that when the anchoring means is secured to a support, the brace elements are locked against pivotal movement.

2. The wine rack according to claim 1 wherein the support members include generally vertically disposed uprights and the brace elements are pivotally secured to the uprights.

3. The wine rack according to claim 1 wherein the support members include generally vertically disposed uprights and the brace elements are secured to tubular members through which the uprights pass and which are rotatable on the uprights.

4. The wine rack according to claim 1 wherein coupling means are provided on the upper and/or lower extremities of the rack to enable a superimposed rack to be coupled to an underlying rack.

5. The wine rack according to claim 4 wherein the coupling means are provided at the upper and/or lower extremities of the uprights.

6. The wine rack according to claim 4 wherein the coupling means is in the nature of spigot and socket means.

7. The wine rack according to claim 4 wherein spigot formations are provided at the upper and/or lower extremities of the uprights and a tubular socket is provided to engage aligned spigots of an underlying and superimposed wine rack.

8. The wine rack according to claim 1 wherein the support members each comprise a plurality of horizontally disposed spaced rod elements formed to a sinuous profile to define alternate peaks and valleys, with the valleys constituting the cradles for the wine bottles.

* * * * *